US011090657B2

(12) United States Patent
Tsai et al.

(10) Patent No.: US 11,090,657 B2
(45) Date of Patent: Aug. 17, 2021

(54) AUTOMATIC PAPER SHREDDER

(71) Applicant: Aurora Office Equipment Co., Ltd. Shanghai, Shanghai (CN)

(72) Inventors: Chung Shih Tsai, Hawthorne, CA (US); Er Ren Zhong, Shanghai (CN); Taokuei Chuang, Shanghai (CN)

(73) Assignee: Aurora Office Equipment Co., Ltd. Shanghai, Shanghai (CN)

( * ) Notice: Subject to any disclaimer, the term of this patent is extended or adjusted under 35 U.S.C. 154(b) by 237 days.

(21) Appl. No.: 16/289,419

(22) Filed: Feb. 28, 2019

(65) Prior Publication Data

US 2020/0276594 A1 Sep. 3, 2020

(51) Int. Cl.
*B02C 18/00* (2006.01)

(52) U.S. Cl.
CPC .. *B02C 18/0007* (2013.01); *B02C 2018/0038* (2013.01); *B02C 2018/0046* (2013.01)

(58) Field of Classification Search
CPC ..... B02C 18/0007; B02C 18/2225; B02C 18/2283; B02C 18/2291; B02C 2018/0038; B02C 2018/0046
USPC ..... 241/100, 236
See application file for complete search history.

(56) References Cited

U.S. PATENT DOCUMENTS

| | | | | |
|---|---|---|---|---|
| 4,192,467 | A * | 3/1980 | Hatanaka | B02C 18/0007 241/100 |
| 8,196,851 | B2 * | 6/2012 | Aries | B02C 18/2225 241/225 |
| 8,672,251 | B2 * | 3/2014 | Aries | B02C 18/2283 241/225 |
| 2004/0164192 | A1 * | 8/2004 | Chang | B02C 18/0007 241/100 |
| 2012/0018554 | A1 * | 1/2012 | Seo | B02C 18/0007 241/101.2 |
| 2015/0258549 | A1 * | 9/2015 | Ahn | B02C 23/02 241/285.3 |
| 2015/0328642 | A1 * | 11/2015 | Shegerian | B02C 18/2216 241/30 |
| 2015/0343451 | A1 * | 12/2015 | Xu | B02C 23/00 241/34 |
| 2016/0318031 | A1 * | 11/2016 | Chang | B02C 18/2241 |
| 2018/0008987 | A1 * | 1/2018 | Tsai | B02C 18/0007 |

* cited by examiner

*Primary Examiner* — Edward T Tolan
*Assistant Examiner* — Katie L. Parr
(74) *Attorney, Agent, or Firm* — WHGC, P.L.C.; John F. O'Rourke; Alexander R. Schlee

(57) ABSTRACT

An automatic paper shredder includes a shredder cover, a paper holding box, a shell, a paper holding plate, a paper holding plate inlet, a paper shredding component, a drive motor, a paper pressing plate, a paper pick-up component, and a waste paper bin. The paper pressing effect is improved through a spliced paper pressing plate, and the paper pick-up effect is improved through a damping plate, a soft rubber piece, and a convex rib, and thus, efficiency is improved. The automatic paper shredder has the characteristics of being highly automated, convenient to use, safe, reliable, structurally simple and cost-effective.

15 Claims, 13 Drawing Sheets

AUTOMATIC PAPER SHREDDER

BACKGROUND

Field of the Invention

The invention relates to the field of paper shredders and in particular to an automatic paper shredder.

Background Art

Paper shredders are composed of a set of rotary blades, a paper comb, and a drive motor. Paper is fed between the mutually-engaged blades to be cut into numerous paper scraps, thereby ensuring the confidentiality. As security equipment, a paper shredder serves a security function, and is capable of keeping modern office environments clean. Thus, paper shredders have become indispensable simple devices in offices.

In the prior art, flip-type automatic paper shredders are provided with a paper pressing plate located on the inner side of an upper cover. However, because the paper pressing plate is of an integrated structure, under the condition where staples or clips are left in a stack of paper, there will be a small contact surface (or contact point) and a large gap between the integrated paper pressing plate and the stack of paper, resulting in a poor paper pressing effect. What is needed is an improvement on existing paper shredders, which solves the aforementioned problems.

BRIEF SUMMARY OF THE INVENTION

In general, the defects of the prior art are overcome by providing an automatic paper shredder which is provided with a spliced paper pressing plate, thereby effectively improving the paper pressing effect, and improving the paper shredding efficiency.

An automatic paper shredder includes a shredder cover, a paper holding box, a shell, a paper holding plate, a paper holding plate inlet, a paper shredding component, a drive motor, a paper pressing plate, a paper pick-up component, and a waste paper bin. The shredder cover is connected with one end of the paper holding box in a pivoted manner and is used for closing or opening the paper shredder. The shell is disposed below the paper holding box and is fixedly connected with the paper holding box. The paper holding plate is disposed on the upper end face of the inner side of the paper holding box and is used for holding paper placed thereon by users. The paper holding plate inlet is formed in the paper holding plate and divides the paper holding plate into a first paper holding plate part and a second paper holding plate part, in which the paper holding plate is obliquely disposed by a predetermined angle with respect to the horizontal plane, and the first paper holding plate part and the second paper holding plate part sequentially incline downwards so that users can place a stack of paper on the first paper holding plate part and the second paper holding plate part conveniently, and the friction force on the stack of paper can be reduced. The paper shredding component includes a first cutter shaft and a second cutter shaft, in which the first cutter shaft and the second cutter shaft are respectively below the left side and the right side of the paper holding plate inlet and are used in cooperation to shred paper entering the paper holding plate inlet. The drive motor is disposed inside the paper holding box, is connected with the first cutter shaft, the second cutter shaft, and the paper pick-up component. The drive motor is used for driving the first cutter shaft, the second cutter shaft, and the paper pick-up component to operate. The paper pressing plate is elastically connected to the lower end face of the shredder cover through a plurality of elastic components, is disposed corresponding to the upper surface of the paper holding plate and is used for tightly pressing against the stack of paper placed on the paper holding plate when the users close the shredder cover. The paper pick-up component includes a paper pick-up roller shaft and paper pick-up rollers, in which the paper pick-up roller shaft is disposed inside the first paper holding plate part, and is proximate to the paper holding plate inlet. The paper pick-up rollers are telescoped around the paper pick-up roller shaft, in which the upper parts thereof partially protrude from the upper surface of the first paper holding plate part via paper pick-up holes formed in the first paper holding plate part. The paper pick-up rollers are driven by the drive motor to rotate, so that the bottom piece of paper in the stack of paper placed on the paper holding plate is driven by the paper pick-up rollers to move towards the inner wall of the paper holding box and then to move reversely under a counter-acting force of the inner wall, and is bent and deformed at the paper holding plate inlet so as to move downwards to enter the paper holding plate inlet. The waste paper bin is disposed inside the shell, is located below the paper holding plate inlet, and is used for collecting paper scraps.

In embodiments, the lower surface of the paper pressing plate is parallel to the upper surface of the paper holding plate. Also, the number of the elastic components is an odd number, and the odd-numbered elastic components are respectively and asymmetrically disposed on two sides of a paper pressing plate inlet. In addition, the paper pressing plate includes a first paper pressing part and a second paper pressing part, in which the first paper pressing part and the second paper pressing part are fixedly connected through a bilateral connecting block, and a paper pressing plate inlet is defined by the first paper pressing part, the second paper pressing part, and the bilateral connecting block, and corresponds to the paper holding plate inlet in position. Moreover, the first paper pressing part and the second paper pressing part are of an asymmetrical-length and nonuniform-thickness structure.

In embodiments, the paper pressing plate further includes an auxiliary paper pressing block, in which the auxiliary paper pressing block is disposed in the middle of an end of the first paper pressing part that is away from the paper pressing plate inlet and is used for conducting auxiliary pressing on the stack of paper placed on the paper holding plate. The paper pressing plate further includes a paper pressing plate roller shaft and paper pressing plate rollers, in which the paper pressing plate roller shaft is disposed on the first paper pressing part and is proximate to the paper pressing plate inlet, and the paper pressing plate rollers are disposed around the paper pressing plate roller shaft.

In embodiments, the paper pressing plate roller shaft and the paper pressing plate rollers are of a rubber-coated or soft rubber-sleeved cylindrical shaft core structure and are used for preventing multiple pieces of paper from being simultaneously shredded. Also, the paper pressing plate further includes a damping plate, in which the damping plate is disposed on the first paper pressing part, is proximate to or attached to the paper pressing plate inlet and is provided with roller through-holes. The paper pressing plate rollers penetrate through the roller through-holes to partially protrude from the lower surface of the first paper pressing part. In addition, the paper pressing plate further includes a soft rubber piece, in which the soft rubber piece is disposed on the damping plate and is located between the paper pressing plate rollers. The upper surface of the soft rubber piece is lower than, or even with, the top horizontal cross-section of each paper pressing plate roller, thereby improving the paper feeding efficiency. The paper pressing plate rollers correspond to the paper pick-up rollers in the vertical direction.

Moreover, the paper pressing plate further includes a convex rib, in which the convex rib is disposed on the second paper pressing part, is proximate to the paper pressing plate inlet, and is used for applying a vertical resolving force to the stack of paper placed on the paper holding plate, so as to guide the paper towards the paper holding plate inlet. The paper pressing plate further includes a shredder cover inlet, in which the shredder cover inlet is formed in the shredder cover. The shredder cover inlet, the paper pressing plate inlet, and the paper holding plate inlet are correspondingly disposed in the vertical direction. The paper pressing plate is matched with the paper holding plate in shape.

Furthermore, the paper holding box includes an upper cover and a lower cover, in which the upper cover includes a first upper cover part and a second upper cover part. The first upper cover part and the second upper cover part are fixedly connected through connecting pieces. The upper cover and the lower cover are fixedly connected. The lower cover and the shell are fixedly connected. The first upper cover part is provided with a pair of insertion holes in a left side and a right side with respect to the second upper cover part. The second upper cover part is provided with a pair of insertion columns on a left side and a right side with respect to the first upper cover part. The first upper cover part and the second upper cover part are joined by inserting the pair of insertion columns into the pair of insertion holes. The connecting pieces are horseshoe-shaped, and the front side and the rear side of the top of each connecting piece are each provided with a connecting buckle. Two connecting holes are correspondingly formed in two sides of each of a left insertion joint and a right insertion joint of the first upper cover part and the second upper cover part and are respectively located on the first upper cover part and the second upper cover part. After the first upper cover part and the second upper cover part are joined by inserting the pair of insertion columns into the insertion holes, the connecting buckles are clamped in the connecting holes to achieve clamped connection of the first upper cover part and the second upper cover part. Also, the paper holding box further includes connecting blocks, in which the connecting blocks are disposed on the back sides of a left insertion joint and a right insertion joint of the first upper cover part and the second upper cover part. The connecting blocks are used for conducting secondary fixation on the left insertion joint and the right insertion joint of the first upper cover part and the second upper cover part with external screws.

Embodiments possess multiple advantages over the prior art. The paper holding plate of the automatic paper shredder is obliquely disposed to better conform to the using habits of users, and thus, the users can place a stack of paper on the paper holding plate conveniently. Meanwhile, the friction force on the stack of paper can be reduced by being disintegrated into a fractional force in the horizontal direction and a fractional force in the vertical direction. The lower surface of the paper pressing plate of the automatic paper shredder is parallel to the upper surface of the paper holding plate so that all corners of the stack of paper placed on the paper holding plate can be tightly pressed and compacted. The paper pressing plate formed by two spliced parts of the automatic paper shredder has a better paper pressing effect than the paper pressing plate of existing integrated structures. Under the condition where staples or clips are left in a stack of paper, there typically will be a small contact surface (or contact point) and a large gap between the paper pressing plate of an integrated structure and the stack of paper. However, by adoption of the paper pressing plate formed by the two spliced parts of the invention, the gap will be greatly decreased, thereby greatly improving the paper pressing effect. The damping plate, the soft rubber piece, and the convex rib are disposed on the lower surface of the paper pressing plate of the automatic paper shredder, so that the horizontal friction force is effectively enhanced, and a vertical resolving force is derived from the friction force by the convex rib, thereby achieving a good guiding effect and improving the paper pick-up effect; the auxiliary paper pressing block is additionally arranged, thereby effectively improving the paper pressing effect. The automatic paper shredder is provided with the shredder cover inlet through which paper can be manually fed when the paper pick-up component in the paper holding box breaks down, and thus, the automatic paper shredder can be used in two ways. The paper pressing effect is effectively improved through the design of the paper pressing plate formed by two spliced parts, and the paper pick-up effect is effectively improved through the damping plate, the soft rubber piece, and the convex rib, thereby improving the paper shredding efficiency. The automatic paper shredder has the characteristics of being high automated, convenient to use, safe, reliable, ingenious in design, simple in structure, and low in cost.

BRIEF DESCRIPTION OF THE DRAWINGS

A brief description of accompanying drawings used for illustrating the embodiments, in which.

Some embodiments are described in detail with reference to the related drawings. Additional embodiments, features and/or advantages will become apparent from the ensuing description or may be learned by practicing the invention. In the FIGURES, which are not drawn to scale, like numerals refer to like features throughout the description. The following description is not to be taken in a limiting sense but is made merely for describing the general principles of the invention.

DETAILED DESCRIPTION OF THE INVENTION

The embodiments of the invention are discussed below with reference to the accompanying drawings.

Figure 1A:
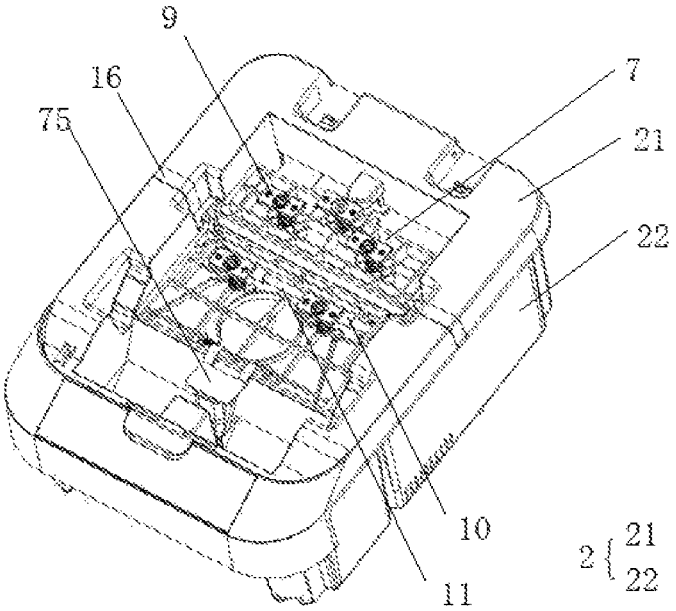
FIG. 1A is a partial structural view of an automatic paper shredder, in accordance with the teachings of the present invention.
Figure 1B:
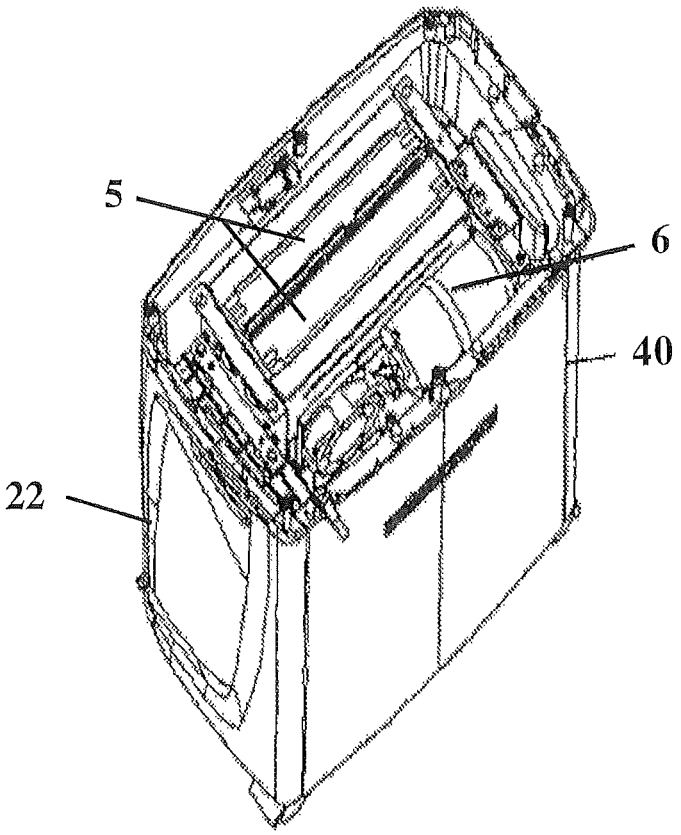
FIG. 1B is a partial structural view of a cross-section of the automatic paper shredder of FIG. 1A, in accordance with teachings of the present invention.

FIG. 1A, FIG. 1B, FIG. 2, and FIG. 8 illustrate embodiments disclosing an automatic paper shredder. In FIG. 1A and FIG. 1B, the automatic paper shredder can include shredder cover 1, paper holding box 2, shell 40, paper holding plate 3, paper holding plate inlet 4, paper shredding component 5, drive motor 6, paper pressing plate 7, paper pick-up component 8, and a waste paper bin 22. Shredder cover 1 is pivotally connected with one end of paper holding box 2 and can be used for closing or opening the paper shredder. Shell 40 is disposed below paper holding box 2 and is fixedly connected with paper holding box 2. Paper holding plate 3 is disposed on the upper end face of the inner side of paper holding box 2 and can be used for holding a stack of paper placed thereon by users (as used herein, a "stack" of paper may include one or more pieces of paper).

Paper holding plate inlet 4 is formed in the paper holding plate 3, and divides paper holding plate 3 into first paper holding plate part 31 and second paper holding plate part 32. Paper holding plate 3 can be obliquely disposed by a predetermined angle with respect to the horizontal plane. First paper holding plate part 31 and second paper holding plate part 32 can sequentially incline downwards so that the users can place a stack of paper on first paper holding plate part 31 and second paper holding plate part 32. A friction force on the stack of paper can be reduced by being decomposed into a fractional force in the horizontal direction and a fractional force the vertical direction. In this embodiment, first paper holding plate part 31 can be longer than second paper holding plate part 32 in the direction perpendicular to paper holding plate inlet 4. That is to say, the paper holding plate 3 can be divided by paper holding plate inlet 4 into two asymmetrical parts. As second paper holding plate part 32 is shorter than first paper holding plate part 31, when staples (or clips) in the stack of paper are located on the side of first paper holding plate part 31, the bottom piece of paper in the stack of paper has a short travel distance, and rapidly enters paper holding plate inlet 4, thereby greatly improving the paper shredding efficiency.

Paper shredding component 5 includes first cutter shaft 51 and second cutter shaft 52, in which first cutter shaft 51 and second cutter shaft 52 can be respectively disposed below the left side and the right side of paper holding plate inlet 4, and can be used in cooperation to shred paper entering the paper holding plate inlet 4. Drive motor 6 is disposed inside paper holding box 2. Drive motor 6 is connected with the first cutter shaft 51, the second cutter shaft 52, and the paper pick-up component 8. Drive motor 6 is used for driving the first cutter shaft 51, the second cutter shaft 52 and the paper pick-up component 8. Paper pressing plate 7 is elastically connected to the lower end face of shredder cover 1 through a plurality of elastic components 9. Paper pressing plate 7 is disposed corresponding to the upper surface of the paper holding plate 3 and is used for tightly pressing against the stack of paper placed on paper holding plate 3, when the users close the shredder cover 1.

Figure 2:
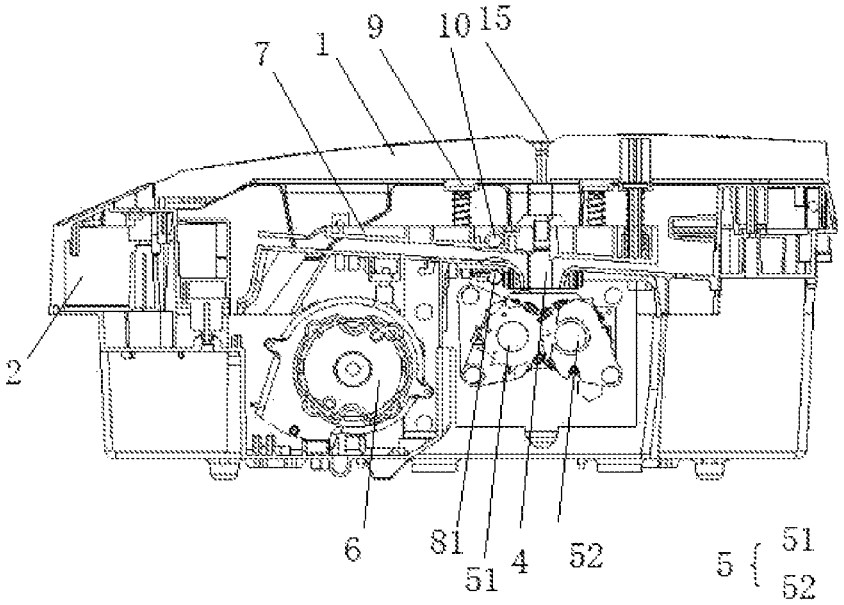
FIG. 2 is a partial cross-sectional view of the automatic paper shredder, in accordance with the teachings of the present invention.

Paper pick-up component 8 includes paper pick-up roller shaft 81 and paper pick-up rollers 82. Paper pick-up roller shaft 81 is disposed inside first paper holding plate part 31 and is proximate to paper holding plate inlet 4. Paper pick-up rollers 82 are telescoped around paper pick-up roller shaft 81. The upper parts of paper pick-up rollers 82 may partially protrude from the upper surface of first paper holding plate part 31 via paper pick-up holes formed in the first paper holding plate part 31. Paper pick-up rollers 82 are driven by the drive motor 6 to rotate, so that the bottom piece of paper in the stack of paper placed on paper holding plate 3 is driven by paper pick-up rollers 82 to move towards the inner wall of paper holding box 2 and then to move reversely under a counter-acting force of the inner wall. The paper is bent and deformed at the paper holding plate inlet 4, so as to move downwards to enter the paper holding plate inlet 4. In this embodiment, the number of paper pick-up rollers 82 is two. However, in actual implementation, there may be no limitation in this regard, and the number of the paper pick-up rollers 82 can be three or more. In addition, the design idea of one-side configuration of paper pick-up component 8 simplifies the paper pick-up structure and reduces the economic cost. Waste paper bin 22 can be disposed inside shell 40, is located below the paper holding plate inlet 4, and is used for collecting paper scraps. As shown in FIG. 2, the lower surface of paper pressing plate 7 can be parallel to the upper surface of paper holding plate 3, so that all corners of the stack of paper on paper holding plate 3 can be tightly pressed and compacted by the paper pressing plate 7. In this embodiment, the odd-numbered of elastic components 9 can be respectively and asymmetrically disposed on two sides of paper pressing plate inlet 74.

Figure 3:
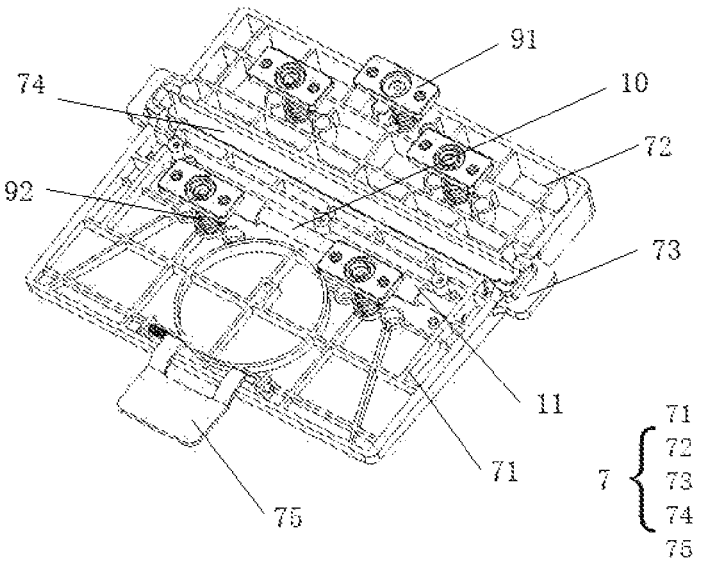
FIG. 3 is a top view of a paper pressing plate of the automatic paper shredder, in accordance with the teachings of the present invention.
Figure 5:
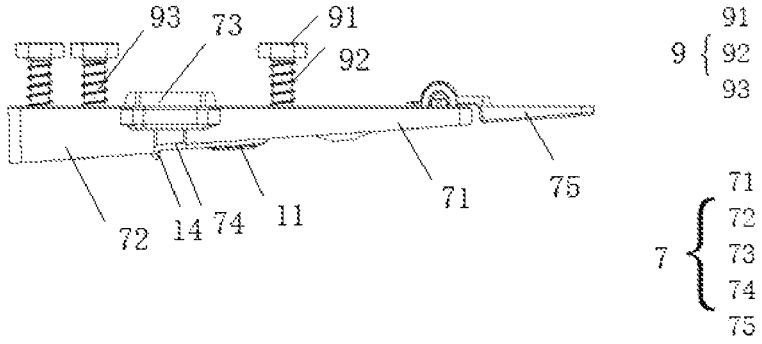
FIG. 5 is a side view of the paper pressing plate of the automatic paper shredder, in accordance with the teachings of the present invention.
Figure 6:
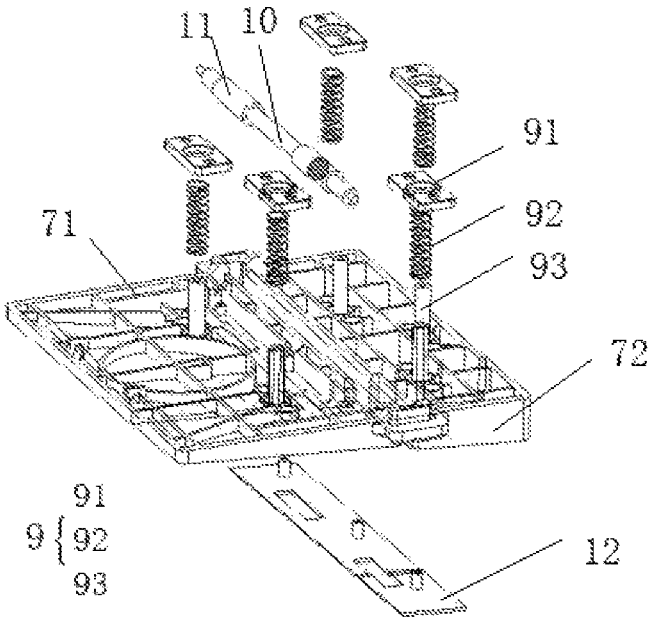
FIG. 6 is an exploded view of the paper pressing plate of the automatic paper shredder, in accordance with the teachings of the present invention.

As shown in FIG. 1A, FIG. 3 and FIG. 6, five sets of elastic components 9 are respectively disposed on the two sides of the paper pressing plate inlet 74. The number of elastic components 9 is not limited to five, and may be three, seven or any number, and this embodiment does not impose limitation on this. Furthermore, as shown in FIG. 5 and FIG. 6, each elastic component 9 includes positioning piece 91, spring 92 and positioning column 93, in which the positioning column 93 can be hollow and is disposed on the upper surface of the paper pressing plate 7. Spring 92 is disposed around positioning column 93, positioning piece 91 is fixedly connected to the lower surface of shredder cover 1. An external screw penetrates through positioning column 93 from the lower surface of paper pressing plate 7 and then is fixedly screwed to positioning piece 91.

Figure 4:
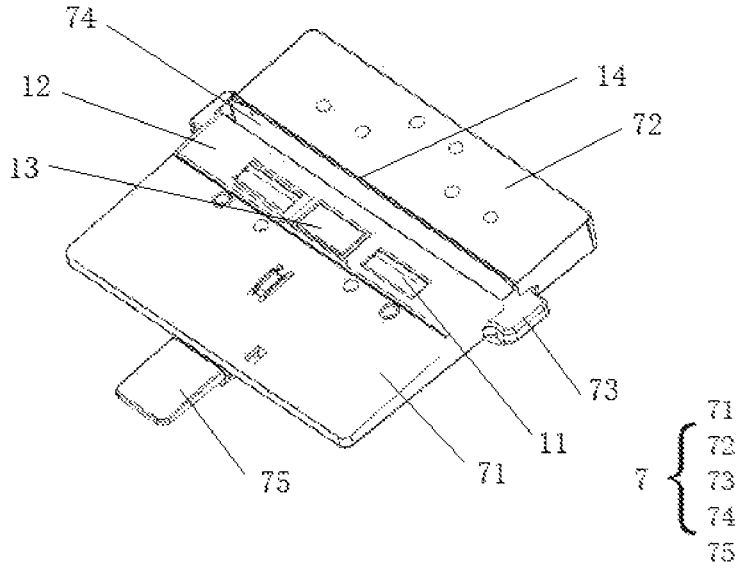
FIG. 4 is a bottom view of the paper pressing plate of the automatic paper shredder, in accordance with the teachings of the present invention.

Furthermore, as shown in FIG. 3, FIG. 4, and FIG. 5, paper pressing plate 7 includes first paper pressing part 71 and second paper pressing part 72, in which first paper pressing part 71 and second paper pressing part 72 are fixedly connected through bilateral connecting block 73. Paper pressing plate inlet 74 is defined by the first paper pressing part 71, the second paper pressing part 72, and the bilateral connecting block 73. Paper pressing plate inlet 74 corresponds to paper holding plate inlet 4 in position. Paper pressing plate 7 formed by the two spliced parts in this embodiment has a better paper pressing effect than a paper pressing plate of an integrated structure in the prior art. Under the condition where staples or clips are left in the stack of paper, there will be a small contact surface (or contact point) and a large gap between the paper pressing plate of an integrated structure and the stack of paper. However, by the adoption of a paper pressing plate formed by the two spliced parts, the gap will be greatly decreased, thereby greatly improving the paper pressing effect.

Furthermore, the first paper pressing part 71 and the second paper pressing part 72 can be of an asymmetrical-length and nonuniform-thickness structure. In this embodiment, first paper pressing part 71 is longer than second paper pressing part 72. First paper pressing part 71 and second paper pressing part 72 each may have a triangular cross section, as shown in FIG. 5 and FIG. 6. Such design also can correspond to the technical characteristic of parallel configuration of the lower surface of paper pressing plate 7 and the upper surface of paper holding plate 3. First paper pressing part 71 can be as long as first paper holding plate part 31, and second paper pressing part 72 can be as long as the second paper holding plate part 32. In such a configuration, paper pressing plate 7 can have a highly-effective paper pressing effect.

As shown in FIG. 1, FIG. 3, FIG. 4, FIG. 5 and FIG. 7, paper pressing plate 7 can further include auxiliary paper pressing block 75, in which auxiliary paper pressing block 75 is disposed in the middle of an end of first paper pressing part 71 that is away from paper pressing plate inlet 74. Auxiliary paper pressing block 75 can be used for conducting auxiliary pressing on the stack of paper placed on paper holding plate 3, thereby further improving the paper pressing effect.

Furthermore, as shown in FIG. 1A, FIG. 3 and FIG. 6, paper pressing plate 7 further includes paper pressing plate roller shaft 10 and paper pressing plate rollers 11, in which paper pressing plate roller shaft 10 is disposed on the first paper pressing part 71 and is disposed proximate to the paper pressing plate inlet 74. Paper pressing plate rollers 11 are disposed around paper pressing plate roller shaft 10. Paper pressing plate roller shaft 10 and paper pressing plate rollers 11 may be made of a rubber-coated or soft rubber-sleeved cylindrical shaft core structure and can be used for preventing multiple pieces of paper from being simultaneously shredded.

Figure 7:
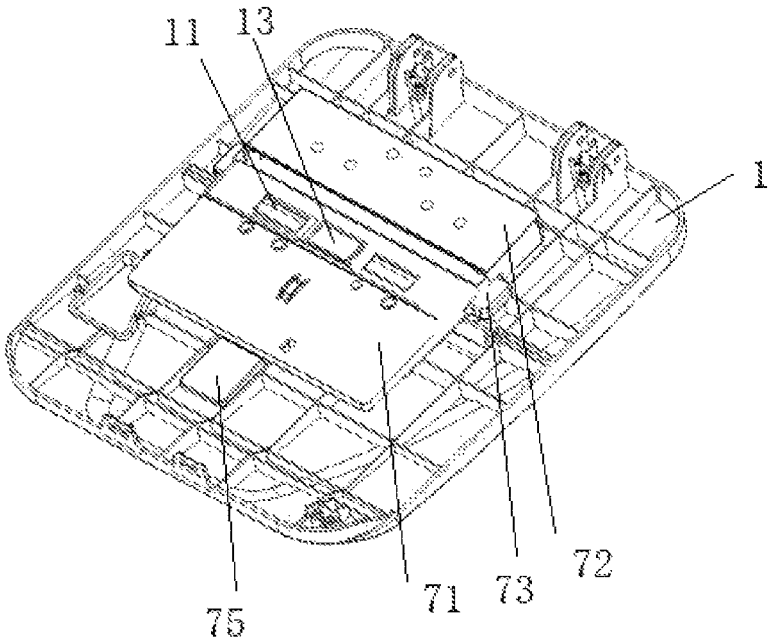
FIG. 7 is an assembled view of the paper pressing plate of the automatic paper shredder, in accordance with the teachings of the present invention of the invention.
Figure 8:
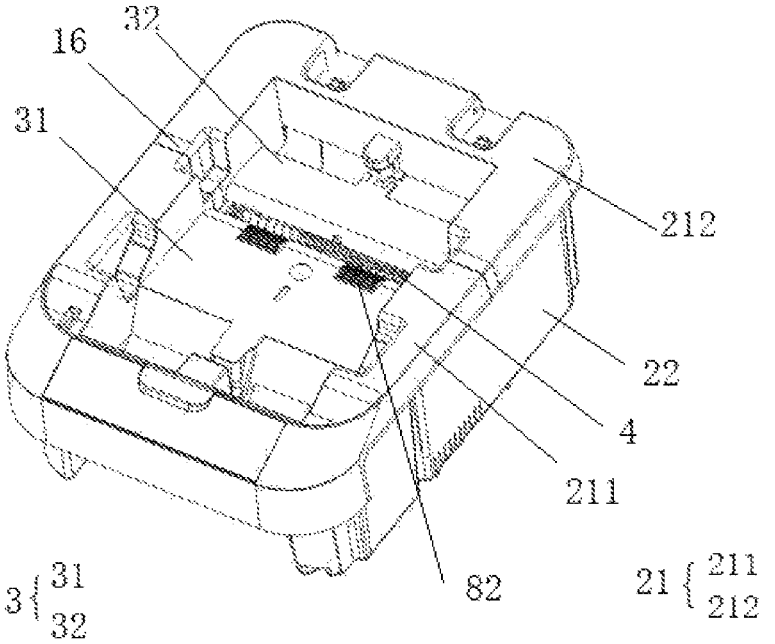
FIG. 8 is a structural view of a paper holding box of the automatic paper shredder, in accordance with the teachings of the present invention.
Figure 9:
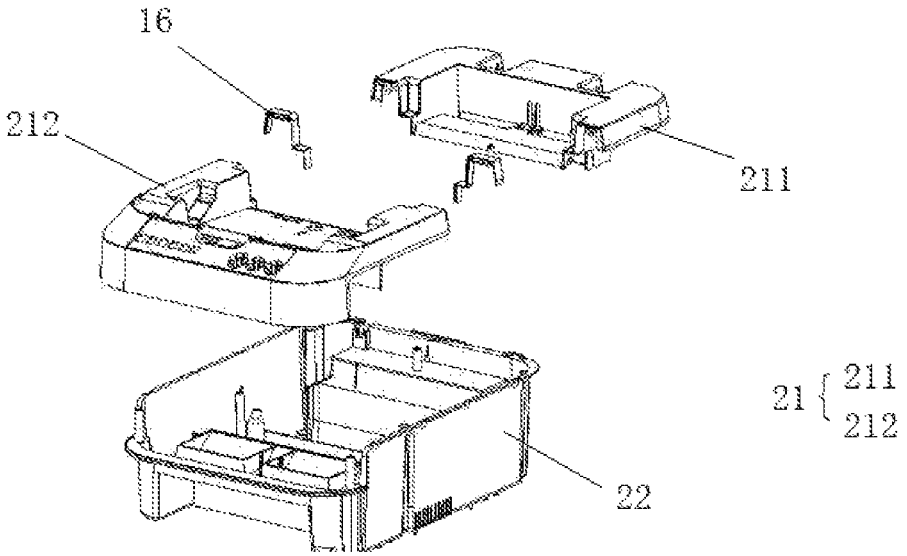
FIG. 9 is an exploded view of the paper holding box of the automatic paper shredder, in accordance with the teachings of the present invention.
Figure 10:
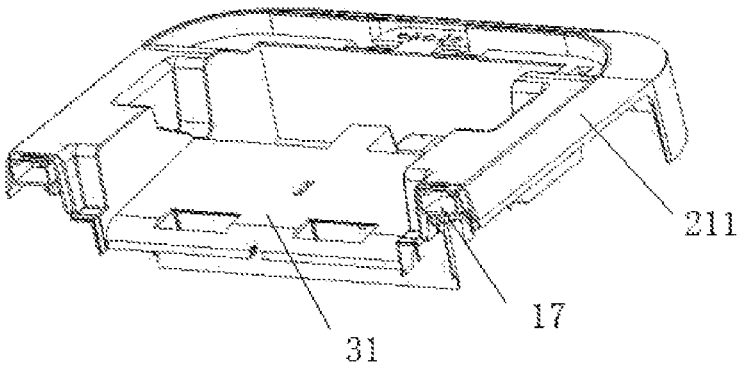
FIG. 10 is a structural view of a first upper cover part of the automatic paper shredder, in accordance with the teachings of the present invention.
Figure 11:
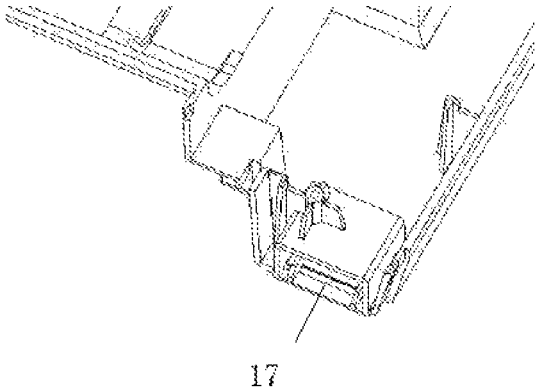
FIG. 11 is an enlarged view of a pair of insertion holes in the first upper cover part of the automatic paper shredder, in accordance with the teachings of the present invention.
Figure 12:
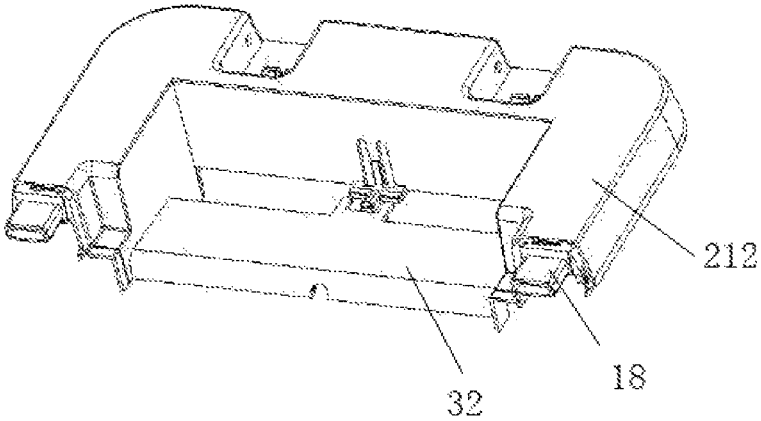
FIG. 12 is a structural view of a second upper cover part of the automatic paper shredder, in accordance with the teachings of the present invention.
Figure 13:
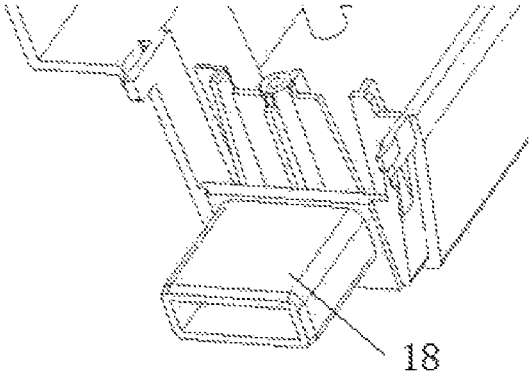
FIG. 13 is an enlarged view of a pair of insertion columns in the second upper cover part of the automatic paper shredder, in accordance with the teachings of the present invention.

Furthermore, as shown in FIG. 4 and FIG. 6, paper pressing plate 7 further includes damping plate 12, in which damping plate 12 is disposed on the first paper pressing part 71 and is proximate to the paper pressing plate inlet 74. Damping plate 12 is provided with roller through-holes (not shown), and paper pressing plate rollers 11 can penetrate through the roller through-holes to partially protrude from the lower surface of first paper pressing part 71. As shown in FIG. 4 and FIG. 7, paper pressing plate 7 further includes soft rubber piece 13. Soft rubber piece 13 is disposed on the damping plate 12 and is located between the paper pressing plate rollers 11. The upper surface of the soft rubber piece 13 is lower than or even with the top horizontal cross-section of each paper pressing plate roller 11, thereby improving the paper feeding efficiency. Particularly, when the paper pressing plate 7 presses downwards to start paper feeding of the paper shredder, paper pressing plate rollers 11 can be in a downward-pressing state. At this moment, the upper surface of soft rubber piece 13 can be higher than the top horizontal cross-section of each paper pressing plate roller 11. The stack of paper placed on paper holding plate 3 can be guided towards paper holding plate inlet 4 more easily, thereby effectively improving the paper feeding efficiency. Paper pressing plate rollers 11 can correspond to paper pick-up rollers 82 in the vertical direction. In this embodiment, the number of paper pressing plate rollers 11 and the number of paper pick-up rollers 82 can be two. However, such are not limiting, and similar technical solutions involving any number of paper pressing plate rollers 11 and any number of paper pick-up rollers 82 also fall within the protection scope of this embodiment.

As shown in FIG. 4 and FIG. 5, paper pressing plate 7 can further include convex rib 14, in which convex rib 14 can be disposed on second paper pressing part 72 Convex rib 14 can be proximate to paper pressing plate inlet 74 and can be used for applying a vertical resolving force to the stack of paper placed on paper holding plate 3 so as to guide the paper into paper holding plate inlet 4.

As shown in FIG. 2, paper pressing plate 7 further includes shredder cover inlet 15 formed in shredder cover 1. Shredder cover inlet 15, paper pressing plate inlet 74 and paper holding plate inlet 4 can be correspondingly disposed in the vertical direction. In this embodiment, when paper pick-up component 8 in the paper holding box 2 malfunctions, paper can be manually fed via shredder cover inlet 15, and thus, the automatic paper shredder can possess dual functionality. Paper pressing plate 7 may be matched in shape with the paper holding plate 3, as shown in FIG. 1. Alternately, paper pressing plate 7 can be larger than or equal to paper holding plate 3. If paper pressing plate 7 is smaller than paper holding plate 3, both ends of the stack of paper may slightly tilt upwards, which may consequentially affect the paper pressing effect.

As shown in FIG. 1A, FIG. 8, FIG. 9, FIG. 17 and FIG. 18, paper holding box 2 can include upper cover 21 and lower cover 22. Upper cover 21 includes first upper cover part 211 and second upper cover part 212. First upper cover part 211 and the second upper cover part 212 are fixedly connected through connecting pieces 16. Upper cover 21 and lower cover 22 can be fixedly connected. Lower cover 22 and the shell are fixedly connected. In this embodiment, the fixed connection manner can be any one selected from common fixed connection manners such as clamped connection, threaded connection, or riveted connection.

As shown in FIG. 10, FIG. 11, FIG. 12 and FIG. 13, first upper cover part 211 can be provided with a pair of insertion holes 17 respectively in a left side and a right side relative to the second upper cover part 212. Second upper cover part 212 is provided with a pair of insertion columns 18 respectively on a left side and a right side, with respect to first upper cover part 211. First upper cover part 211 and second upper cover part 212 can be connected with each other by inserting the pair of insertion columns 18 into the pair of insertion holes 17.

Figure 14:
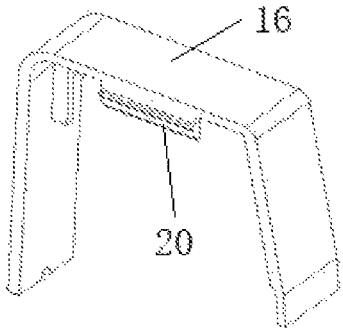
FIG. 14 is a top view of a connecting piece of the automatic paper shredder, in accordance with the teachings of the present invention.
Figure 15:
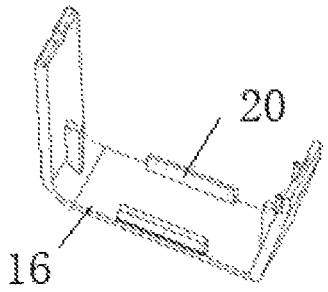
FIG. 15 is a bottom view of the connecting piece of the automatic paper shredder, in accordance with the teachings of the present invention.
Figure 16:
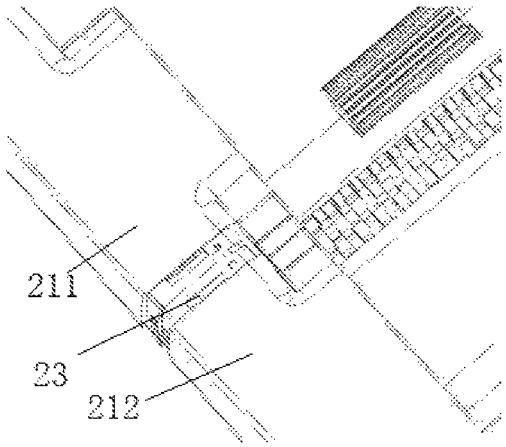
FIG. 16 is a structural view of the automatic paper shredder after the first upper cover part and the second upper cover part of the automatic paper shredder are inserted into each other, in accordance with the teachings of the present invention.
Figure 17:
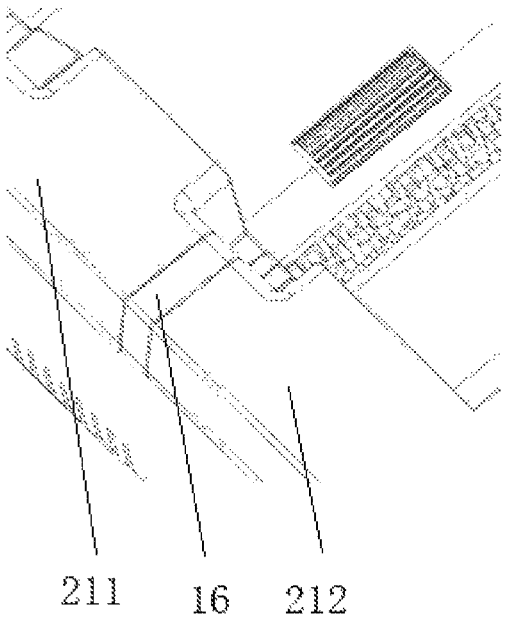
FIG. 17 is a structural view of the automatic paper shredder after the first upper cover part and the second upper cover part of the automatic paper shredder are inserted into each other and are assembled with connecting pieces, in accordance with the teachings of the present invention.
Figure 18:
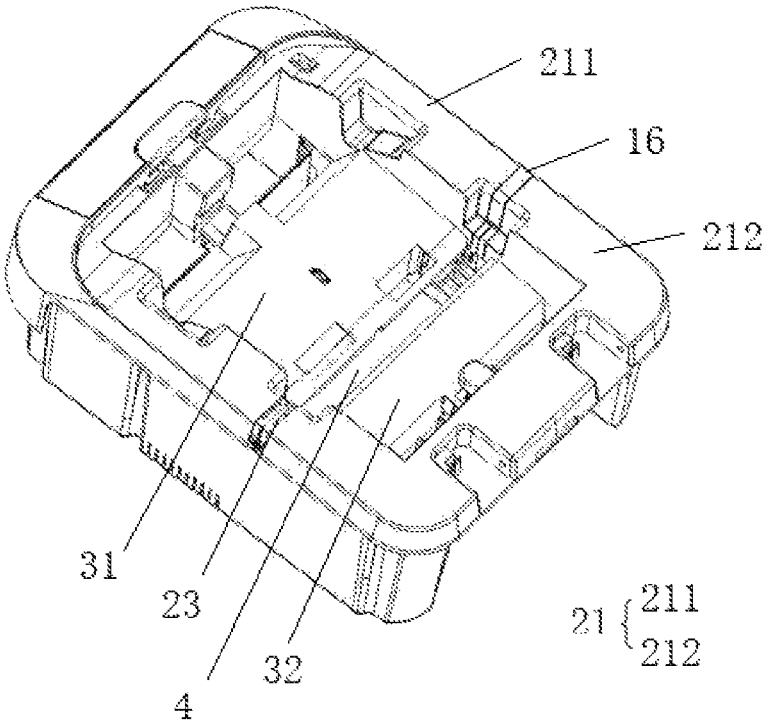
FIG. 18 is a structural view of the automatic paper shredder when one of the first upper cover part and the second upper cover part of the automatic paper shredder is assembled with a connecting piece, and the other of the first upper cover part and the second upper cover part is not assembled with a connecting piece, in accordance with the teachings of the present invention.

As shown in FIG. 14, FIG. 15 and FIG. 16, connecting pieces 16 can be horseshoe-shaped, and the front side and the rear side of the top of each connecting piece 16 can each be provided with a connecting buckle 20. Two connecting holes are correspondingly formed in two sides of each of a left insertion joint and a right insertion joint of first upper cover part 211 and second upper cover part 212. The two connecting holes are respectively located on first upper cover part 211 and second upper cover part 212. After first upper cover part 211 and second upper cover part 212 are connected with each other by inserting the pair of insertion columns 18 into insertion holes 17, connecting buckles 20 can be clamped in connecting holes 23 to achieve clamped connection of first upper cover part 211 and second upper cover part 212.

Figure 19:
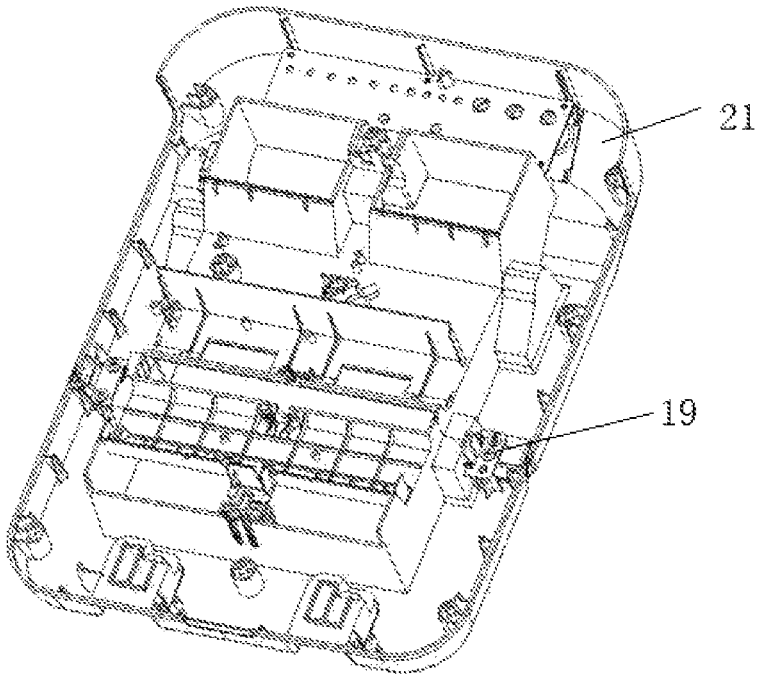
FIG. 19 is a structural view of the back side of an upper cover of the automatic paper shredder, in accordance with the teachings of the present invention.

As shown in FIG. 19, paper holding box 2 can further include connecting blocks 19, in which connecting blocks 19 are disposed on the back sides of a left insertion joint and a right insertion joint of first upper cover part 21 and second upper cover part 212. Connecting blocks 19 are used for conducting secondary fixation on the left insertion joint and the right insertion joint of first upper cover part 211 and second upper cover part 212 with external screws.

As variations, combinations and modifications may be made in the construction and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments but defined in accordance with the foregoing claims appended hereto and their equivalents.

The invention claimed is:

1. An automatic paper shredder, comprising:

a shell;

a shredder cover;

a paper holding box;

a paper holding plate having a paper holding plate inlet;

a paper shredding component, the paper shredding component having a first cutter shaft and a second cutter shaft, a drive motor coupled to the paper shredding component;

a paper pressing plate having a first paper pressing part, a second paper pressing part, a paper pressing plate roller shaft, and paper pressing plate rollers; and a paper pick-up component, wherein:

the shredder cover is pivotally connected with one end of the paper holding box, and closes or opens the paper shredder, the shell is disposed below and fixedly connected to the paper holding box, the paper holding plate is disposed on an upper end face of an inner side of the paper holding box and holds paper placed thereon, the paper holding plate inlet is formed in the paper holding plate and divides the paper holding plate into a first paper holding plate part and a second paper holding plate part, the paper holding plate is obliquely disposed at a predetermined angle with respect to a horizontal plane, and the first paper holding plate part and the second paper holding plate part sequentially incline downwards to allow the paper to be placed thereon and to reduce a friction force on the paper, the first cutter shaft and the second cutter shaft are respectively disposed below a left side and a right side of the paper holding plate inlet and cooperate to shred paper entering the paper holding plate inlet, the drive motor is disposed inside the paper holding box, and is connected with the first cutter shaft, the second cutter shaft, and the paper pick-up component, and drives the first cutter shaft, the second cutter shaft and causes the paper pick-up component to operate, the paper pressing plate is elastically connected to a lower end face of the shredder cover through a plurality of elastic components, and is disposed correspondingly to an upper surface of the paper holding plate, and tightly presses against the paper placed on the paper holding plate when the shredder cover is closed, the first paper pressing part and the second paper pressing part are fixedly connected through a bilateral connecting block, and a paper pressing plate inlet is defined by the first paper pressing part, the second paper pressing part and the bilateral connecting block and corresponds to the paper holding plate inlet in position, the paper pressing plate roller shaft is disposed on the first paper pressing part and is proximate to the paper pressing plate inlet, and the paper pressing plate rollers are disposed around the paper pressing plate roller shaft, the paper pick-up component includes a paper pick-up roller shaft and paper pick-up rollers, the paper pick-up roller shaft is disposed inside the first paper holding plate part and is proximate to the paper holding plate inlet, and the paper pick-up rollers are supported on and rotationally fixed to the paper pick-up roller shaft for joint rotation therewith, and upper parts of the paper pick-up rollers partially protrude from an upper surface of the first paper holding plate part via paper pick-up holes formed in the first paper holding plate part, so that the paper pick-up rollers are driven by the drive motor to rotate, and a bottom piece of paper in the paper placed on the paper holding plate is driven by the paper pick-up rollers to move towards an inner wall of the paper holding box and then to move reversely under a counter-acting force of the inner wall and is bent and deformed at the paper holding plate inlet so as to move downwards to enter the paper holding plate inlet.

2. The automatic paper shredder according to claim 1, wherein a lower surface of the paper pressing plate is parallel to the upper surface of the paper holding plate.

3. The automatic paper shredder according to claim 1, wherein the number of the elastic components is an odd number, and the odd-numbered elastic components are respectively and asymmetrically disposed on two sides of an inlet of the paper pressing plate.

4. The automatic paper shredder according to claim 1, wherein the first paper pressing part and the second paper pressing part are of an asymmetrical-length and nonuniform-thickness structure.

5. The automatic paper shredder according to claim 1, wherein the paper pressing plate further comprises an auxiliary paper pressing block, wherein the auxiliary paper pressing block is disposed in a middle of an end of the first paper pressing part that is away from the paper pressing plate inlet and is used for conducting auxiliary pressing on the paper placed on the paper holding plate.

6. The automatic paper shredder according to claim 1, wherein the paper pressing plate rollers are rubber-coated or soft rubber-sleeved and are used for preventing multiple pieces of paper from being simultaneously shredded.

7. The automatic paper shredder according to claim 1, wherein the paper pressing plate further comprises a damping plate, wherein the damping plate is disposed on the first paper pressing part, and is proximate to or attached to the paper pressing plate inlet and is provided with roller through-holes, and the paper pressing plate rollers penetrate through the roller through-holes to partially protrude from a lower surface of the first paper pressing part.

8. The automatic paper shredder according to claim 7, wherein the paper pressing plate further comprises a soft rubber piece, wherein the soft rubber piece is disposed on the damping plate and is located between the paper pressing plate rollers, and an upper surface of the soft rubber piece is lower than or even with a top horizontal cross-section of each said paper pressing plate roller, thereby improving paper feeding efficiency.

9. The automatic paper shredder according to claim 1, wherein the paper pressing plate rollers correspond to the paper pick-up rollers in a vertical direction.

10. The automatic paper shredder according to claim 1, wherein the paper pressing plate further comprises a convex rib, wherein the convex rib is disposed on the second paper pressing part, and is proximate to the paper pressing plate inlet and is used for applying a vertical resolving force to the paper placed on the paper holding plate so as to guide the paper towards the paper holding plate inlet.

11. The automatic paper shredder according to claim 1, wherein the paper shredder further comprises a shredder cover inlet, wherein the shredder cover inlet is formed in the shredder cover, and the shredder cover inlet, the paper pressing plate inlet and the paper holding plate inlet are correspondingly disposed in a vertical direction.

12. The automatic paper shredder according to claim 1, wherein the paper pressing plate is matched in shape with the paper holding plate.

13. The automatic paper shredder according to claim 1, wherein the paper holding box comprises an upper cover and a lower cover, wherein the upper cover comprises a first upper cover part and a second upper cover part, the first upper cover part and the second upper cover part are fixedly connected through connecting pieces, the upper cover and the lower cover are fixedly connected, and the lower cover and the shell are fixedly connected.

14. The automatic paper shredder according to claim 13, wherein the first upper cover part is provided with a pair of insertion holes respectively in a left side and a right side with respect to the second upper cover part, and the second upper cover part is provided with a pair of insertion columns respectively in a left side and a right side with respect to the first upper cover part, and the first upper cover part and the second upper cover part are connected with each other by inserting the pair of insertion columns into the pair of insertion holes.

15. The automatic paper shredder of claim 1, wherein: the paper pressing plate is spliced; and wherein the lower surface of said paper pressing plate includes: a damping plate disposed on the first paper pressing part, a soft rubber piece disposed on the paper-facing side of the damping plate, and a convex rib disposed on the second paper pressing part.

* * * * *